United States Patent [19]

Miller

[11] 4,254,975

[45] Mar. 10, 1981

[54] GATE LATCH APPARATUS

[76] Inventor: David A. Miller, Rte. 2, Box 213, Okmulgee, Okla. 74447

[21] Appl. No.: 960,302

[22] Filed: Nov. 13, 1978

[51] Int. Cl.[3] ..... E05C 17/36

[52] U.S. Cl. ..... 292/264; 24/116 R; 292/274; 292/341.17; 292/DIG. 13

[58] Field of Search ..... 292/264, 274, 272, 304, 292/341.17, DIG. 13, DIG.16; 70/93; 24/116 R, 116 A; 49/394

[56] References Cited

U.S. PATENT DOCUMENTS

| | | | |
|---|---|---|---|
| 546,102 | 9/1895 | Jenkins | 292/264 |
| 1,418,373 | 6/1922 | Goddard | 24/116 R |
| 1,797,230 | 3/1931 | Gillet | 24/116 R |
| 2,608,231 | 8/1952 | Johnson | 24/116 R X |
| 3,720,431 | 3/1973 | Oliver et al. | 292/264 |

FOREIGN PATENT DOCUMENTS

| | | | |
|---|---|---|---|
| 241783 | 10/1962 | Australia | 24/116 R |
| 858417 | 12/1970 | Canada | 292/304 |
| 23752 | of 1913 | United Kingdom | 292/264 |

*Primary Examiner*—William E. Lyddane
*Attorney, Agent, or Firm*—James H. Chafin

[57] ABSTRACT

A gate latching apparatus which incorporates a chain segment and a cooperating latch plate assembly. The latch plate assembly has a chain link receiving slot and a gravity operated keeper whereby the chain may be latched by pushing it against the keeper and into the slot but requires separate manipulation of the keeper in order to remove the chain from the slot.

9 Claims, 8 Drawing Figures

GATE LATCH APPARATUS

BACKGROUND OF THE INVENTION

1. Field of the Invention

The present invention relates to a closure latching apparatus and more particularly, but not by way of limitation, to a gate latch for use with livestock enclosures.

2. History of the Prior Art

The farmer or ranchers who raises livestock has long encountered the problem of providing a gate latch which will withstand severe weather, is easy to operate, and is difficult if not impossible for the livestock animal itself to operate.

It is well known in raising livestock and particularly horses, that such animals have an uncanny ability to manipulate an ordinary gate latch with their mouths and free themselves from their enclosure. This problem is particularly prevalent in both field gates and stall doors.

Various latches have been developed having spring loaded mechanisms whereby the latch keeper may be manipulated against the force of the spring to allow the gate or door to be latched and then later manipulated again in the unlatching process. However, these complicated spring loaded devices normally have a short use life in that the spring becomes rusty or after repeated use becomes weak and the latch fails.

There are many gravity operated keepers utilized in connection with latching mechanisms but for the most part, if these keepers may be raised out of position, a gentle nudge on the gate or closure will cause the device to open. Therefore, if a horse or other animal raises the keeper and presses against the gate at the same time the gate will automatically open defeating the purpose of the latch.

SUMMARY OF THE PRESENT INVENTION

The present invention provides a gate latching apparatus which has been particularly designed and constructed to overcome the above disadvantages. The present device includes an elongated chain which may be attached to either of the closure members. Attached to the opposite closure member is the latching apparatus which includes a flat plate member that may be constructed in steel or stainless steel and which is provided with an open-ended slot of sufficient size to receive the link of the chain therein.

Pivotally attached to this plate member above the slot is a freely swinging keeper device, the lower portion of which is provided with a notch having the following characteristics. The notch has one face thereof which, when the keeper is hanging in a vertical position is parallel to the upper or inside surface of the open-ended slot. The other surface of the notch in this free hanging position serves as dog member to close off the end of the slot.

In order to operate the latching mechanism, one link of the chain may be pushed against the keeper, pivoting the keeper rearwardly thereby allowing that link of the chain to be inserted into the slot. After the link of chain has been inserted far enough into the slot, the keeper will swing back into its vertical position so that the notch serves to close off the open end of the slot.

An attempt to remove the chain from the slot without first moving the keeper causes the chain to encounter the dog portion of the keeper and further movement will tend to try to make the keeper swing forwardly.

However, the side of the notch adjacent to the inside edge of the slot will be forced against the chain link itself preventing a forward swinging movement of the keeper member and thereby keeping the slot end closed. To remove the chain from the slot it is necessary to push the keeper rearwardly past the slot opening.

If the gate or closure is one that opens outwardly or forwardly with respect to the plate member, the plate member should be mounted on the movable gate portion itself and the chain mounted on the post. Therefore, if the animal is able to move the keeper up out of position, forward pressure on the gate or enclosure will simply cause the link of the chain beyond the one that is in the slot to be forced against the slot thereby keeping the closure from opening.

If on the other hand the gate is one that opens inwardly, it would be best to mount the plate member on the post or frame member and attach the chain end to the movable closure member.

Again, if the animal is able to raise the keeper member out of position, a rearward or opening movement against the gate itself will cause the outside link to pull against the slot thereby keeping the closure from opening.

Since the keeper is simply pivotally mounted by the bolt or pivot pin, it is extremely resistant to rust or deterioration and hence will be useful for a long period of time regardless of the conditions.

DESCRIPTION OF THE DRAWINGS

Other and further advantageous features of the present invention will hereinafter more fully appear in connection with a detailed description of the drawings in which.

DETAILED DESCRIPTION OF THE PREFERRED EMBODIMENT

Figure 1:
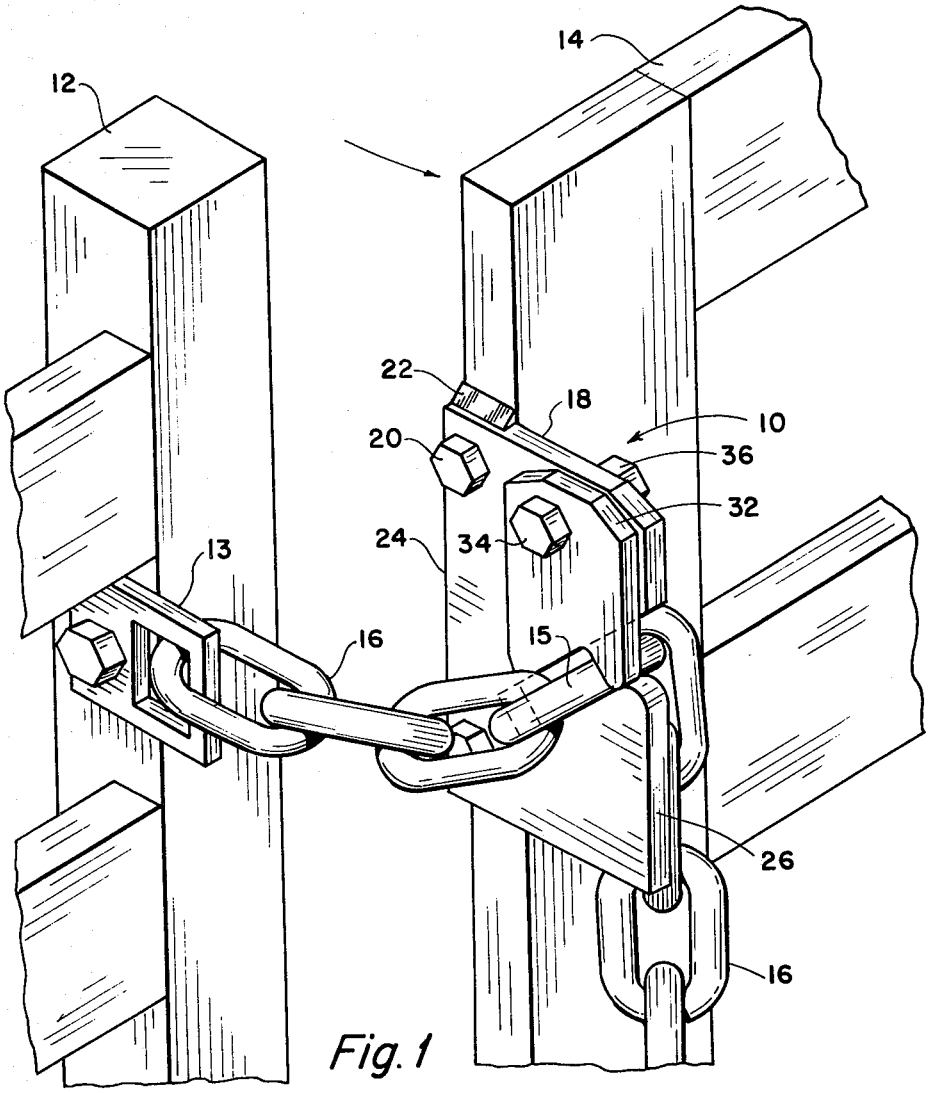
FIG. 1 is a perspective view of a gate having a latch embodying the present invention.

Referring to the drawings in detail, reference character 10 generally indicates a latching apparatus for closure members which may be in the form of gates, doors and the like. Referring to FIG. 1 the closure member is indicated by a fence post or frame member 12 and a movable or hinged gate member 14.

The latching apparatus 10 generally comprises an elongated flexible latching member 16 such as a chain or the like having interlocking links, one end of the chain being attached to the post member 12 by any well known manner such as by a bracket 13 in the case of wooden posts or by welding in the case of metal posts.

The latching apparatus also comprises a vertically diposed latch plate 18 which is secured to the edge of the gate 14 such as by the nuts and bolts 20 or by welding in the case of metal gates indicated by reference character 22.

Figure 8:
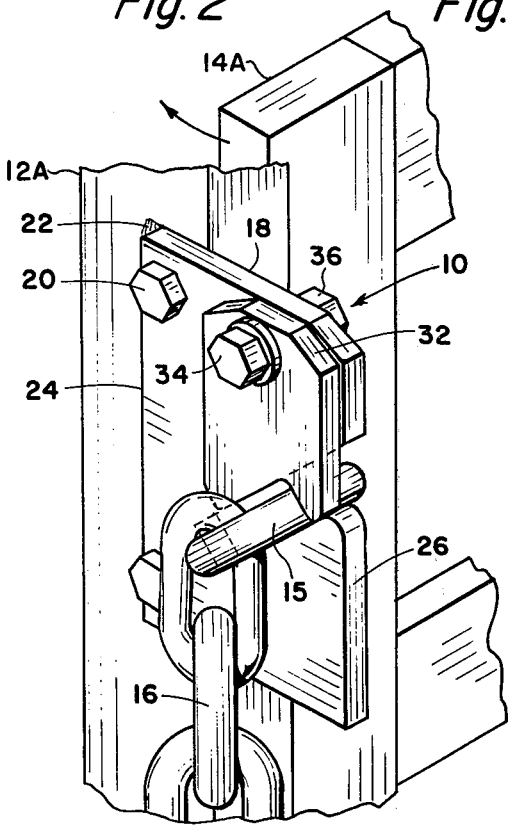
FIG. 8 is a perspective view of a second gate having a latch embodying the invention.
Figure 5:
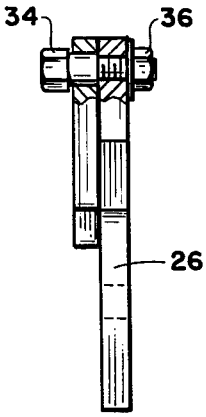
FIG. 5 is a front elevational view of the latch member of FIG. 2.

It is noted that FIG. 8 shows a similar post 12A and gate 14A which opens inwardly instead of outwardly. In this case, the plate 18 attaches to the post 12A and the chain 16 attaches to the gate 14A.

The plate 18 consists of a rear edge portion 24 and an oppositely disposed outwardly extending front edge portion 26. The plate 18 is provided with an elongated slot 28 which extends from the forward edge 26 of the plate rearwardly and downwardly into the plate with the front end of the slot 28 being open at 30. The width of the slot 28 is a little larger than the width of the chain links of the chain 16 and the depth or length of the slot 28 must be greater than the width of each of the links of the chain 16.

Figure 2:
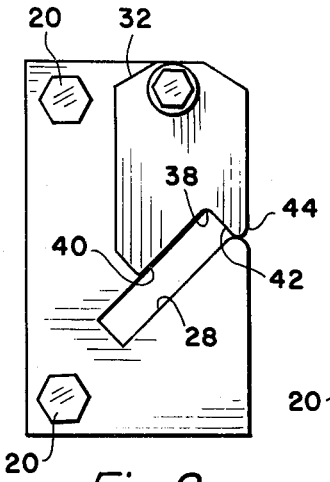
FIG. 2 is a side elevational view of the latch mechanism of FIG. 1 with the keeper in a first position.

A keeper member 32 is pivotally attached at its upper end of the plate 24 directly above the slot 28. The keeper member 32 is attached to be free-swinging, the attachment means being any well known means such as a shouldered bolt 34 and oppositely disposed nut and washer assembly 36. The lower end of the keeper 32 is provided with an inverted L-shaped notch 38 having an elongated flat edge surface 40 and a shorter edge surface 42 at substantially right angles thereto thereby forming a protrusion or dog member 44 at the front end of the keeper. The notch 38 is sized and shaped such that when the keeper 32 is hanging in a vertical position as shown in FIG. 2, the elongated edge 40 thereof is parallel to the upper inside edge of the slot 28 and the shorter edge or the notch 42 serves to close off the open end 30 of the slot 28 when viewed from the side as shown in FIGS. 2, 3 and 4.

Figure 3:
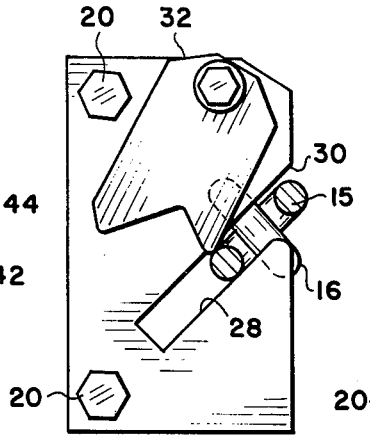
FIG. 3 is a side elevational view of the latch member of FIG. 2 with the keeper in second position.
Figure 4:
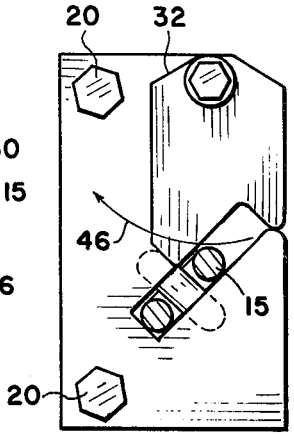
FIG. 4 is a side elevational view of a latch mechanism in FIG. 2 shown in a latched position.

When the user desires to latch the closure member, one link of the chain 16 is pushed against the dog member 44 thereby pivoting the keeper member rearwardly as shown in FIG. 3. A chain link 15 of the chain 16 is then pushed to the lower end of the slot as shown in FIG. 4 whereby the keeper member 32 swings forwardly back to its vertical position. It is noted that at this point that the notch 28 needs to be of sufficient length so that a chain link 15 of the chain 16 when in its lowest position is shown in FIG. 4 allows the dog member 44 to swing over the chain back to its original position along the arc indicated by reference character 46.

It can be further seen that an attempt to remove the chain without first swinging the keeper 32 rearwardly causes the front end of the chain link which is in the slot to encounter the surface 42 of the notch and any further outward pressure causes the elongated edge 42 of the notch to encounter the chain link 15 restricting any further forward movement of the chain, thereby keeping the latch closed.

To remove the chain 16 from the slot 28, the keeper member 32 must be manually pivoted rearwardly in order to open up the slot passageway thereby allowing the chain to be removed.

Figure 6:
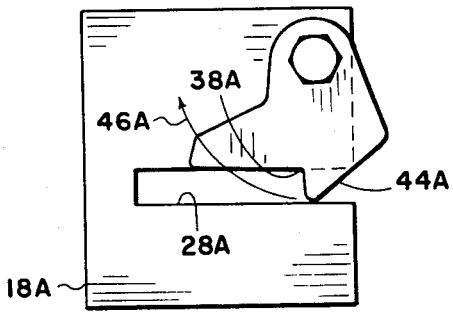
FIG. 6 shows a side elevational view of a second embodiment of the latch mechanism.

Referring now to FIG. 6, it can be seen that the slot 28A may be horizontally oriented and likewise a keeper member 32A is provided with a notch 38A made to conform to this horizontal slot thereby providing a dog member 44A. However, it is also seen that, being horizontally mounted it is necessary that the slot be longer in order that the keeper can swing through the arc 46A and avoid the chain located therein.

Figure 7:
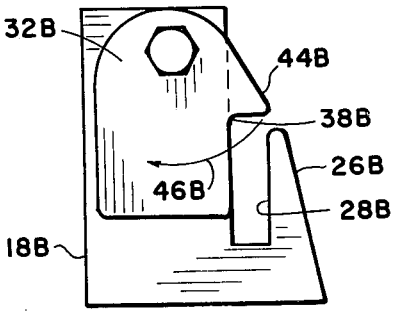
FIG. 7 is a side elevational view of a third embodiment of the latch mechanism.

Referring now to FIG. 7, it can be seen that the plate member 18B may be provided with a slanting front face 26B and a downwardly extending slot 28B. In this case, the keeper 32B is provided with a corresponding notch 38B and dog 44B. In this particular case, the slot 28B need not be as deep as either in the embodiment shown in FIGS. 1 through 5 or the embodiment shown in FIG. 6 since the arc 46B of the dog member does not pass through a great portion of the slot which would allow the dog member to clear the chain link inserted in the slot. However, the applicant herein has determined that although the slot may be of substantially any orientation, a slot set near a 45° angle as shown in FIGS. 1 through 5 provides a comfortable and easily operated latching mechanism and hence it is felt to be the preferred embodiment.

From the foregoing, it is apparent that the present invention provides an easily operated gate latch mechanism which is durable in construction and which would be extremely difficult to be opened by livestock animals.

Whereas the present invention has been described in particular relation to the drawings attached hereto, other and further modifications apart from those shown or suggested herein may be made within the spirit and scope of the invention.

For example, it is not necessary that an actual chain be used with the locking mechanism in that any flexible member having a flattened portion or segment suitable for inserting within the slot 28 may be used in place of a chain. However, a chain offers several added benefits such as being able to use substantially any link of the chain thereby allowing the closure to be partially open. On the other hand, if it is desired to lock the gate, the free end of the chain may be wrapped around both the post and the end gate member and then be locked by means of a padlock or the like (not shown).

What is claimed is:

1. A latching apparatus for securing closure members which are movable with respect to each other, the latching apparatus comprising:

(a) a vertically disposed first plate member, the rear edge of which is securable to one of the closure members, an elongated slot provided in the plate member, the slot being open at the front edge of the plate member;

(b) an elongated free-swinging keeper member pivotally mounted at its upper end to the first plate member above the open ended slot, a substantially right angle notch provided in the keeper member such that when the keeper member is hanging vertically, a first edge of the notch is in parallel alignment with one edge of the slot and the second edge of the notch is perpendicular to and adjacent the outer open end of the slot, the combination of the slot and the notch forming a rectangular transverse aperture; and (c) an elongated flexible latch member having one end secured to the opposite closure member and having at least one latch engagement segment insertable within the slot such that upon pushing the latch engagement segment into the slot, the keeper member is pivoted rearwardly, the length of the slot being such as to permit the latch engagement member to be inserted into the slot by a sufficient distance to allow the keeper member to pivot forwardly to resume its vertical orientation, the second edge of the notch serving to prevent removal of the latch engagement segment without first pivotally moving the keeper member rearwardly in order to clear the slot.

2. A latching apparatus as set forth in claim 1 wherein the elongated slot extends rearwardly and downwardly.

3. A latching apparatus as set forth in claim 1 wherein the elongated slot extends downwardly.

4. A latching apparatus as set forth in claim 1 wherein the elongated slot extends rearwardly.

5. A latching apparatus as set forth in claim 1 wherein the elongated flexible latch member is a chain of interlocking links, each link serving as a latch engagement segment.

6. A gate latch for use with a chain of interlocking links comprising:

a vertically disposed plate member securable to a gate member and having a front edge portion exposed, an open aperture provided in the front edge portion of the plate member forming an elongated edge member extending from the front edge of the plate member into the plate member and terminating with a second edge member at a substantial right angle thereto;

an elongated free-swinging keeper pivotally mounted at one end to the plate member above the open aperture, a substantially right-angled notch provided in the keeper such that when the keeper is freely hanging, a first elongated edge of the notch being parallel to the elongated edge member of the plate member and spaced therefrom by a distance larger than the thickness of an interlocking link of the chain and the second edge of the notch being substantially parallel to the second edge member of the open aperture and spaced therefrom thereby forming a rectangular aperture therein;

the elongated edge of the open aperture of the frame member and the elongated first edge of the notch member being of sufficient length with respect to the width of an interlocking chain link to allow the keeper to resume its free-hanging position after the chain link is inserted against the second edge member of the open aperture;

whereby said chain link may be pushed against the keeper to pivot said keeper rearwardly away from the elongated edge member of the open aperture until said link is against the second edge of the open aperture allowing the keeper to resume its free-hanging position thereby forming a rectangular aperture, locking said chain link therein and whereby to remove said chain link requires physical pivoting of the keeper rearwardly past the chain link.

7. A gate latch as set forth in claim 6 wherein the elongated edge member of the open aperture is substantially horizontal.

8. A gate latch as set forth in claim 6 wherein the elongated edge member of the open aperture extends rearwardly and downwardly.

9. A gate latch as set forth in claim 6 wherein the elongated edge member of the open aperture is substantially vertical.

* * * * *